US007458382B2

(12) United States Patent
Blyden

(10) Patent No.: US 7,458,382 B2
(45) Date of Patent: Dec. 2, 2008

(54) HOT COMPRESSING TOOTH HAIR COMB

(75) Inventor: Jason Blyden, Brooklyn, NY (US)

(73) Assignee: Lovely Strands LLC, Greenacres, FL (US)

( * ) Notice: Subject to any disclaimer, the term of this patent is extended or adjusted under 35 U.S.C. 154(b) by 0 days.

(21) Appl. No.: 10/905,180

(22) Filed: Dec. 20, 2004

(65) Prior Publication Data

US 2006/0130865 A1 Jun. 22, 2006

(51) Int. Cl.
*A45D 24/06* (2006.01)

(52) U.S. Cl. ..... 132/129

(58) Field of Classification Search ..... 132/129, 132/117, 118, 128, 126, 143, 229, 231, 245, 132/156, 152–154, 224; 219/222–227
See application file for complete search history.

(56) References Cited

U.S. PATENT DOCUMENTS 621,705 A * 3/1899 Rasnick ..... 132/281
1,034,859 A 8/1912 Anderson
1,197,264 A * 9/1916 Cobb ..... 132/136
1,523,461 A 1/1925 Swan
1,536,669 A 5/1925 Grant
1,633,893 A * 6/1927 Hymer ..... 132/150
1,861,040 A 3/1932 Williams
2,406,490 A 8/1946 Day
2,545,885 A 3/1951 Jackson
2,590,447 A 3/1952 Nord
2,598,330 A 5/1952 Wilson
3,065,759 A 11/1962 Lewis
3,088,471 A * 5/1963 Fiore ..... 132/136
3,742,964 A 7/1973 Newbern
3,760,821 A 9/1973 Weddington
4,126,143 A 11/1978 Schroeder
4,702,265 A 10/1987 Weddington
5,449,007 A * 9/1995 Arnhols ..... 132/136

* cited by examiner

*Primary Examiner*—Robyn Doan
*Assistant Examiner*—Rachel A Running
(74) *Attorney, Agent, or Firm*—Akerman Senterfitt

(57) ABSTRACT

A hair comb having hot compressing teeth, which in an open mode are shrouded by cooler combing teeth designed to encapsulate hair, and in a triggered mode collapse toward each other to compress the hair confined between the cooler teeth. The compressing teeth are mounted to a collapsible mechanism actuated by the comb's user. Various means may be utilized to transfer thermal energy to the heated teeth, and to allow the combing teeth to remain at a lower temperature.

8 Claims, 3 Drawing Sheets

HOT COMPRESSING TOOTH HAIR COMB

BACKGROUND OF THE INVENTION

This invention is in the field of hair grooming accessories. In this field one desired look is to possess straight and styled hair, however that often becomes an overwhelming task when first presented with a head of curly or bristly hair. The effects of compression and heat application to straighten this type of hair are well known, and have been incorporated in a variety of prior grooming accessories.

Consider the earlier electrically heated teeth on combs shown in the U.S. Pat. Nos. 3,760,821 and 4,702,265 issued to W. T. Weddington, U.S. Pat. Nos. 1,034,859 issued to G. Anderson, U.S. Pat. No. 1,536,669 issued to C. Grant, U.S. Pat. No. 2,590,447 issued to S. R. Nord, Jr., et al. Other types of heated combs and pressing devices are shown in U.S. Pat. Nos. 1,523,461 issued to J. Swan; U.S. Pat. No. 1,861,040 issued to J. E. B. Williams; U.S. Pat. No. 2,406,490 issued to D. A. Day; U.S. Pat. No. 2,545,885 issued to H. F. Jackson; U.S. Pat. No. 2,598,330 issued to E. Wilson; and U.S. Pat. No. 3,065,759 issued to F. Lewis.

Those apparatus fall within the chief categories of either the hinged opposing-tong 'flatiron' design, or alternatively, the pick-like 'pressing comb' design. Each category presents several disadvantages.

For instance, the amount of hair captured by flatirons widely varies, thus capturing large volume hair locks that absorb heat and pressure unevenly through the bulk by way of the outer strands receiving more than the inner strands. Distribution of heat and pressure is distributed more evenly when smaller locks of hair are captured, but that increased the overall time and effort required to treat the full head of hair.

And pressing combs, such as those disclosed in U.S. Pat. Nos. 3,742,964 to Newbern and U.S. Pat. No. 4,126,143 to Schroeder, have a score of fixed teeth acting to harvest a score of small-volume locks, however it is difficult, if not impossible to exert even pressure or heat on the harvested hair. The heat and compression is exerted onto the hair locks by skillfully and carefully maneuvering and manipulating the comb. There are a limited number of strokes the comb's user may employ that are limited within the range of drawing hair sideways through the comb teeth, to twisting it—much in the way spaghetti stays on a fork after twirling it onto the fork tines.

Both categories of combs necessarily incur repetitive strokes that typically repeat treatment on post-treated strands. What is more, each category type lacks the ability to treat hair strands close to their root.

SUMMARY OF THE INVENTION

The objects of the present invention are to achieve several advantageous features over the prior art—principally to press and heat hair with consistent delivery, in a time efficient manner. An actuator triggered by the comb's user collapses together a plurality of 'pressing comb' type teeth acting together like a multitude of miniature 'flat irons'. This delivers the benefit of delivering a consistent heat and pressure application throughout the full bulk and length of all the hair. By eliminating the need to select and press small sections at a time required by flatirons, and by eliminating repetitious and repeated strokes required by pressing combs, the present invention remarkably decreases the amount of time required to style a full head of hair.

The invention's combing teeth surround the pressing teeth. The pressing teeth are heatable, and prevented from touching the head's scalp by the lower temperature combing teeth that surround the heatable teeth. Acting as a barrier, the combing teeth act to eliminate the incidence of accidentally burning one's scalp, otherwise presented by the hot teeth of ordinary 'pressing combs'.

In the unactuated open mode, the invention possesses the overall general shape of a pressing comb. In the actuated compressed mode, the hot teeth are engaged to collapse together and press and heat the captured hair as if by a multitude of miniature flatirons. The present features of the design and its modalities allow the acting teeth to style hair closer to its root, and apart from that convey an unprecedented high degree of maneuverability that allows the user to execute a greater number of styling strokes to achieve a greater variety of final hairdo styles.

In the best mode embodiment, a folding gate combined with a flat plate and leaf spring arrangement, is mounted at the base of the collapsible heatable teeth to allow for a synchronous compressing-collapse of those teeth. And also in which, these teeth are sized to allow a slight air gap between their border with the cooler shrouding combing-teeth.

Related objects and advantages of the present invention will be apparent from the following description.

DESCRIPTION OF THE PREFERRED EMBODIMENTS

Figure 1A:
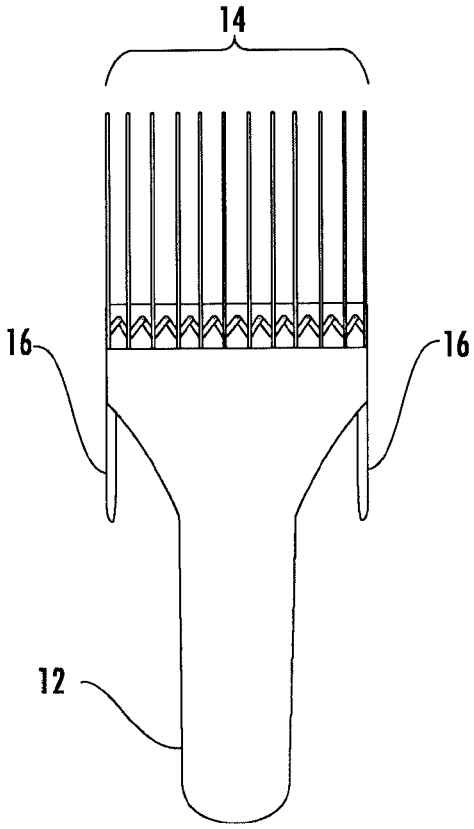
FIG. 1A is a broad view of one embodiment the invention, designed in the overall shape of a hair pick.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1B:
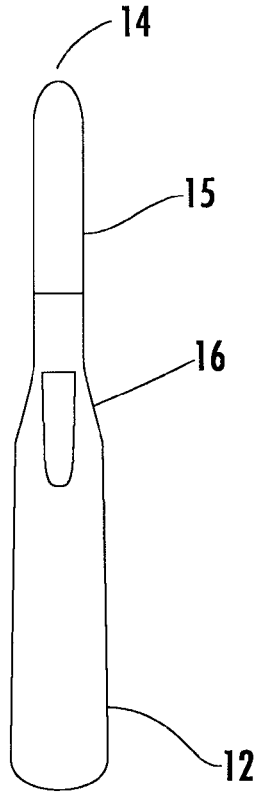
FIG. 1B is a side view of the pick shape embodiment of the invention.
Figure 2A:
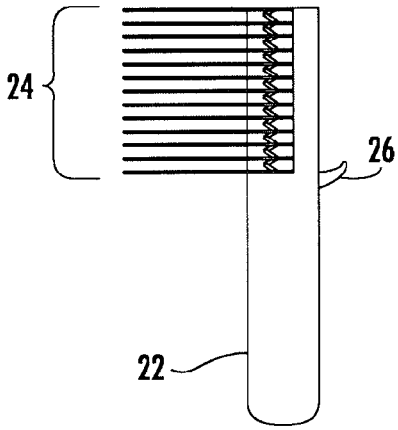
FIG. 2A is a broad view of another embodiment of the invention, designed in the overall shape of a hair comb.
Figure 2B:
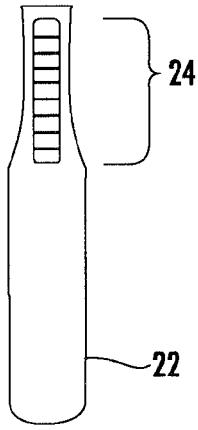
FIG. 2B is a side view of the comb shape embodiment of the invention.

FIGS. 1A and 1B show the preferred embodiment of the invention in the overall shape of a hair pick, having a row set of combing teeth 14 parallel to the longitudinal midline M-L axis of a body-handle 12, and furthermore having a set of triggers 16. In an alternative configuration a row set of combing teeth 24 is perpendicular to a body-handle 22, and further having a singular trigger 26.

Figure 3A:
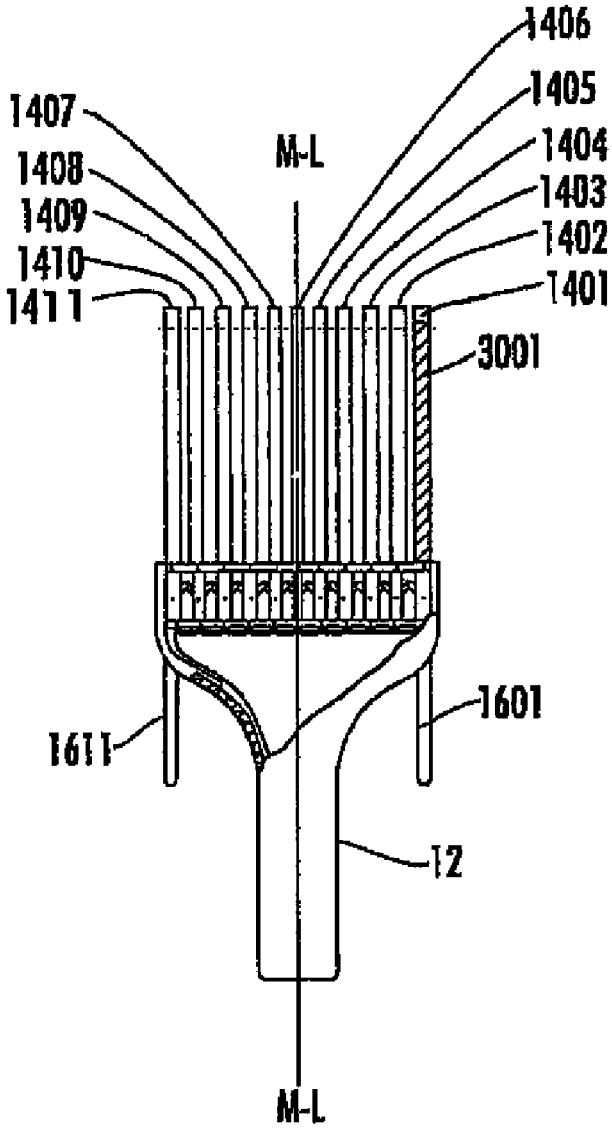
FIG. 3A is a detailed cutaway view of the embodiment shown in FIG. 1A.
Figure 3B:
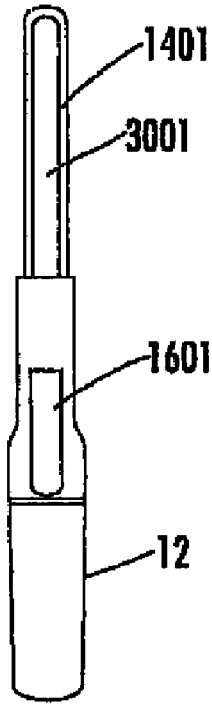
FIG. 3B is a detailed cutaway view of the embodiment shown in FIG. 2B.
Figure 4B:
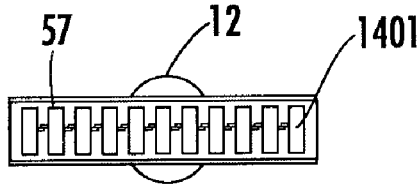
FIG. 4B is a top view of the embodiment shown in FIG. 4A.
Figure 4A:
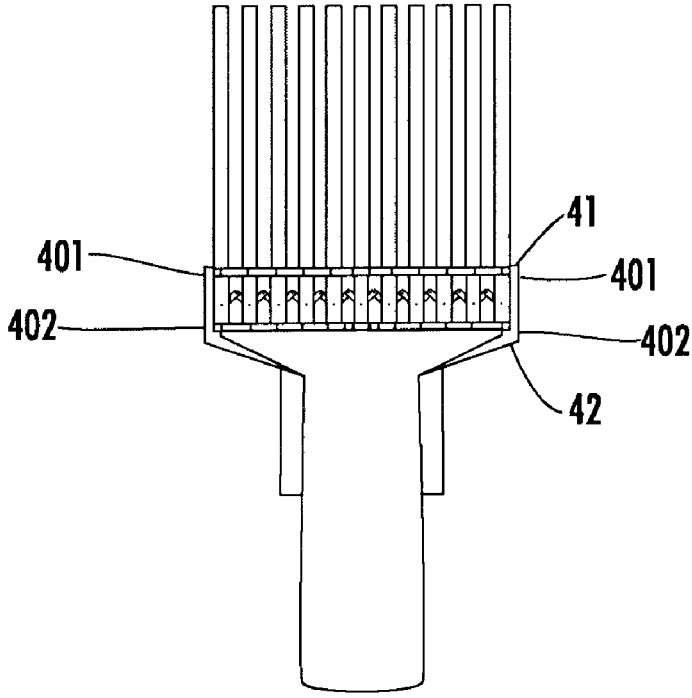
FIG. 4A is a detailed cutaway view of another pick shaped embodiment of the invention.

The preferred embodiment as shown in FIGS. 1A and 1B is presented in the respective views of FIGS. 3A and 3B in more detail by way of cutaway illustration. To the extent that the invention has an open mode and a compressed mode, let it be known that all figures contained within this specification depict the invention the open mode.

Now referring to FIG. 3A, although more or less may be present, the row of combing teeth 14 is comprised of eleven (11) combing teeth, numbered 1401 through 1411. A midline M-L runs along the central axis of combing tooth 1406 and continuing through the center of the body-handle 12. The body-handle possesses sufficient dimensionality and material properties to withstand hand-forced stresses without bending or breaking.

The combing tooth set 14 is mounted to the body-handle 12. In alternate designs not shown, the combing tooth set 14 may be adjustably adapted to the body-handle 12 to allow the user to variably set width spaces between the teeth of the tooth set 14. In an untriggered open mode, as shown in FIGS. 3A and 3B, the combing tooth 1401 cutaway shows an otherwise shrouded slideable heatable tooth 3001. And shrouded within each remaining combing tooth 1402-1411 is a respective slideable heatable tooth 3001.

The combing teeth are generally elliptical in cross-section and have rounded tips at the end distal from the handle-body 12. In other words, the length of each slideable heatable tooth is shorter than each combing tooth.

Two (2) of the combing teeth, 1401 and 1411, each have one outer side panel 16 typical of that shown in FIG. 1B. Each side panel 16 shields and prevents the user from coming into contact with the heatable teeth respectively housed within combing tooth 1401 and 1411.

The trigger set 16 is more specifically enumerated trigger 1601 and trigger 1611 for the purpose of pointing out that each those triggers are formed as an extension from a heatable tooth 3001.

Figure 5:
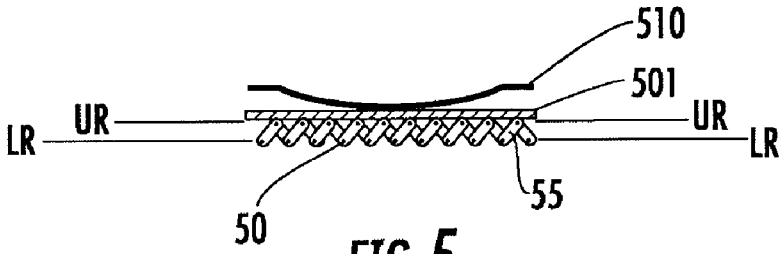
FIG. 5 is a broad view of a folding gate mechanism.

As independently illustrated in FIG. 5, a folding gate 50 is made of a link 55 (typical) and rotatable pin 57 (typical) consecutive series—half of what is commonly known as a 'Boswick Gate'. With eleven (11) heatable teeth , the folding gate 50 would necessarily be comprised of a quantity of twenty links 55, and a quantity of twenty-one rotatable pins 57 constructed whereby the links 55 are connected in series by one rotatable pin 57 at each link's end.

The folding gate 50 is set and slideably mounted within the handle-body 12, as shown in FIG. 5. The folding gate 50 forms an upper row UR of ten rotateable pins 57 and a lower row LR of eleven rotatable pins 57. In this embodiment each heated tooth 14 has, with consistent dimensionality, a primary stabilizing peg 41 (typical) and a secondary stabilizing peg 42 (typical) are fixedly mounted to each slideable heatable tooth at the end proximate to the handle-body 12. Each rotatable pin 57 of the lower row LR is rotatably mounted to a respective slideable heatable tooth 3001, at the point on the tooth midway between the primary 41 and secondary stabilizing pegs.

The assembled folding gate 50 and heatable teeth 3001-3011 is mounted within the handle-body 12. The heatable teeth remain collinear to the handle-body 12 by having the secondary pins 41 (typical) slideably mounted within a upper linear track 401, and the tertiary pins 42 (typical) slideably mounted within a lower linear tract 402.

Each heated tooth 3001 is set and re-set to the open mode (shrouded position within each respective combing tooth 1401-1411) by way of leveling the folding gate 50 rotatable pin upper row UR by the action of a flat plate 501 urged to rest atop the folding gate 50 by a leaf spring 510.

Actuating the trigger set 16 collapses together the slideable heatable teeth 3001 through 3011. When actuated by the trigger set 16, the sliding heated teeth move in unison toward one another. Alternate mechanisms not shown may allow the slideable heatable teeth to independently move with excursions amongst them varying upon the amounts of hair captured between them.

Alternate means may be utilized that replicate the function of the folding gate in the present invention, such as (i) a full 'Boswick' gate (a serial 'XXXXXXXXXX' type linkage), or (ii) a ribbed and resilient-elastic bladder bellows mechanism reckoned to that of a musical accordion (fixing heatable teeth to the ribs), or (iii) a serial hydraulic spring-dampened piston arrangement (fixing heatable teeth between the consecutive piston-cylinder junctions). A parallel hydraulic spring-dampened piston arrangement (fixing heatable teeth between the consecutive piston-cylinder junctions) would function to allow the slideable teeth 3001-3011 to independently move with excursions amongst them varying upon the amounts of hair captured between them.

The combing teeth set 14 are fabricated of a material possessing sufficiently light mass and low rates of thermal absorption sufficient to avoid burning the head scalp. The heatable teeth are fabricated of a metallic or ceramic material possessing a high rate of thermal conduction, a high retentive thermal mass, and surfaced with non-stick coatings, all sufficient to efficiently withstand and deliver heat and pressure to locks of hair compressed between the heated teeth. In the open mode, a narrow gap exists along the border of the outer periphery of each heatable tooth 3001 and its closest corresponding combing tooth 1401-1411.

The heatable teeth may be heated by means of electrical resistant heating elements within each heatable tooth, connected by a wiring harness and grounding safety circuitry that ultimately reduces to exit the handle-body as a singular power cord fitted with a plug adapted to mate with standard power supply outlets.

Thermal energy (heat) may also be delivered to the heatable teeth by submersing the teeth (and the combing teeth set 14) in a hot liquid medium, such as hot water or hot oil.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A hot compressible tooth hair comb comprising:

a plurality of combing teeth aligned in an array, extending from and parallel to a longitudinal midline of a body-handle, whereby each of said combing teeth are formed and sized to shroud a shorter-extending heatable tooth;

a plurality of heatable teeth equal in number to the number of said combing teeth, wherein each said heatable tooth is formed and sized to glide within said combing tooth array;

said heatable teeth are aligned parallel to the longitudinal midline of said body-handle, and mounted to a collapsible mechanism having a plurality of junctions equal in number to at least the number of heatable teeth, whereby each heatable tooth is mounted to one of said junctions;

at least one trigger arranged to collapse together said heatable teeth; and a leveling mechanism acting to restore all heatable teeth to their shrouded positions, each to within a respective combing tooth after a triggered collapse, wherein said combing teeth are fabricated of a material possessing sufficiently light mass and low rates of thermal absorption, and said heatable teeth are fabricated of a metallic or ceramic material possessing a high rate of thermal conduction, a high retentive thermal mass, and surfaced with a non-stick coating.

2. The invention of claim 1, wherein the junctions of the collapsible mechanism move in unison.

3. The invention of claim 1, wherein the outermost two (2) of the plurality of combing teeth are each formed with a side panel.

4. The invention of claim 1, whereby said heatable teeth are formed and arranged within said combing teeth so as to allow a narrow gap to exist along the border of the outer periperhy of each heatable tooth and the inner periperhy of its corresponding shrouding combing tooth.

5. The invention of claim 1, wherein a system of electrical wiring, circuitry and elements provide a thermal heat source within the center of each heatable tooth.

6. The invention of claim 1, wherein said combing teeth are formed to consist of a generally elliptical cross-sectional area, and further formed with rounded tips at the end distal from the handle-body.

7. The invention of claim 1, wherein said combing teeth and said heatable teeth are mounted and aligned perpendicular to the body-handle.

8. A hot compressible tooth hair comb comprising:

a plurality of combing teeth aligned in an array, extending from and parallel to a longitudinal midline of a body-handle, whereby each of said combing teeth are formed and sized to shroud a shorter-extending heatable tooth;

a plurality of heatable teeth equal in number to the number of said combing teeth, wherein each said heatable tooth is formed and sized to glide within said combing tooth array;

said heatable teeth are aligned parallel to the longitudinal midline of said body-handle, and mounted to a collapsible mechanism having a plurality of junctions equal in number to at least the number of heatable teeth, whereby each heatable tooth is mounted to one of said junctions;

at least one trigger arranged to collapse together said heatable teeth; and a leveling mechanism acting to restore all heatable teeth to their shrouded positions, each to within a respective combing tooth after a triggered collapse, wherein the collapsible mechanism is a folding gate formed by a link and a rotatable pin consecutive series, whereby every second rotateable pin is the junction at which a heatable tooth is mounted;

and whereby each said heatable tooth remains collinear to said body by the stationary operation of a secondary pin and a tertiary pin fixed to each side of said rotateable pin, wherein each said secondary pin and said tertiary pin is respectively mounted within an upper linear track and lower linear track of said handle-body;

and wherein said leveling mechanism is a flat plate that is urged to rest atop said folding gate by a leaf spring.

* * * * *